US005933083A

United States Patent [19]

Sobczynski et al.

[11] Patent Number: 5,933,083

[45] Date of Patent: Aug. 3, 1999

[54] WANDER ALARM

[75] Inventors: Michael A. Sobczynski, Cheektowaga; Wesley A. Wakefield, Lockport, both of N.Y.

[73] Assignee: Curbell, Inc., Orchard Park, N.Y.

[21] Appl. No.: 09/067,856

[22] Filed: Apr. 27, 1998

[51] Int. Cl.[6] ..... G08B 21/00

[52] U.S. Cl. ..... 340/573.4; 340/568.1; 340/573.1

[58] Field of Search ..... 340/573.4, 573.1, 340/568.1

[56] References Cited

U.S. PATENT DOCUMENTS

| | | | |
|---|---|---|---|
| 4,577,185 | 3/1986 | Andersen | 340/573.4 |
| 4,583,084 | 4/1986 | Henderson et al. | 340/573.4 |
| 4,616,113 | 10/1986 | Jank et al. | 200/61.13 |
| 4,692,749 | 9/1987 | Bussing, Jr. | 340/574 |
| 4,858,622 | 8/1989 | Osterweil | 128/782 |
| 4,888,580 | 12/1989 | Distel | 340/573.1 |
| 5,066,943 | 11/1991 | Demirel et al. | 340/573.4 |
| 5,374,919 | 12/1994 | Zelka et al. | 340/574 |
| 5,494,046 | 2/1996 | Cross | 128/782 |
| 5,587,704 | 12/1996 | Foster | 340/573.1 |

*Primary Examiner*—Glen Swann

*Attorney, Agent, or Firm*—Hodgson, Russ, Andrews, Woods & Goodyear, LLP

[57] ABSTRACT

The present invention operates when a fastening means connects to a patient. The fastening means attaches to one end of a flexible member and at the other end of the flexible member is a spherical member. The apparatus limits the distance the patient can move. This predetermined distance is the length of the flexible member, the fastening means and the spherical member. The spherical member is removably mounted to a control housing. The control housing has a signalling device that generates a signal when the patient moves beyond the pre-determined distance. The spherical member triggers the signalling device when the patient, from any direction, moves beyond the pre-determined distance which exerts a pulling force upon the spherical member.

9 Claims, 6 Drawing Sheets

WANDER ALARM

FIELD OF THE INVENTION

The present invention relates to an apparatus that generates an alarm when a patient moves beyond a predetermined distance, in particular, the patient can be in any direction relative to the apparatus just beyond the predetermined distance to trigger the alarm.

BACKGROUND OF THE INVENTION

In one type of patient monitoring systems, a fastener is connected to a monitoring housing by a cord or other device having a fixed length so that if the fastener moves beyond that length, the monitoring system housing is activated. The fastener is connected to a patient such as to the clothing of patient by a clip so that, if the patient moves beyond a fixed distance such as by slumping from a wheelchair onto the floor or moving from a bed, the monitoring housing provides an alarm.

In a prior art monitoring system of this type, the end of the cord opposite to the fastener is loosely fitted into the monitoring housing so that when the patient moves away from the monitoring housing a distance greater than the length of the cord, the opposite end is pulled free. When the opposite end is pulled free from the monitoring housing, an alarm is given. Prior art systems of this type are disclosed in U.S. Pat. Nos. 4,577,185, 4,858,622, and 4,583,084. These types, however, can only be mounted in limited places.

In these patents, the fastener is connected to the monitoring housing by either a plug (U.S. Pat. Nos. 4,577,185 and 4,583,084) or a chip (U.S. Pat. No. 4,858,622). In either case, the plug or the chip (collectively "straight input") inserts into a receptive slot of the monitoring housing. That insertion occurs at 180° relative to the slot. Similarly, the straight input is removed when pulled with a force that occurs near or at about 180° relative to the slot. That 180° pulling force is only possible when the patient is relatively in front of the slot. The straight input is not easily removed when the patient is at any other angles, i.e., 145° to 0.0°, relative to the slot. To provide a safe environment under all types of circumstances, the straight input should be easily removable at all angles that the patient can be relative to the monitoring device. Unfortunately, those patents do not disclose such a safe environment.

A problem to solve with the present invention is to design an apparatus and method for monitoring the movement of a patient that provides a safe environment for patients under all circumstances and at all angles relative to the apparatus.

SUMMARY OF THE INVENTION

The present invention details an apparatus and method for monitoring the movement of a patient. The invention operates when a fastening means connects to the patient. The fastening means attaches to one end of a flexible member and at the other end of the flexible member is a spherical member. The apparatus limits the distance the patient can move. This predetermined distance is the length of the flexible member, the fastening means and the spherical member. The spherical member is removably mounted to a control housing. The control housing has a signalling device that generates a signal when the patient moves beyond the pre-determined distance. The spherical member triggers the signalling device when the patient, from any direction, moves beyond the pre-determined distance which exerts a pulling force upon the spherical member.

DETAILED DESCRIPTION OF THE INVENTION

Figure 1:
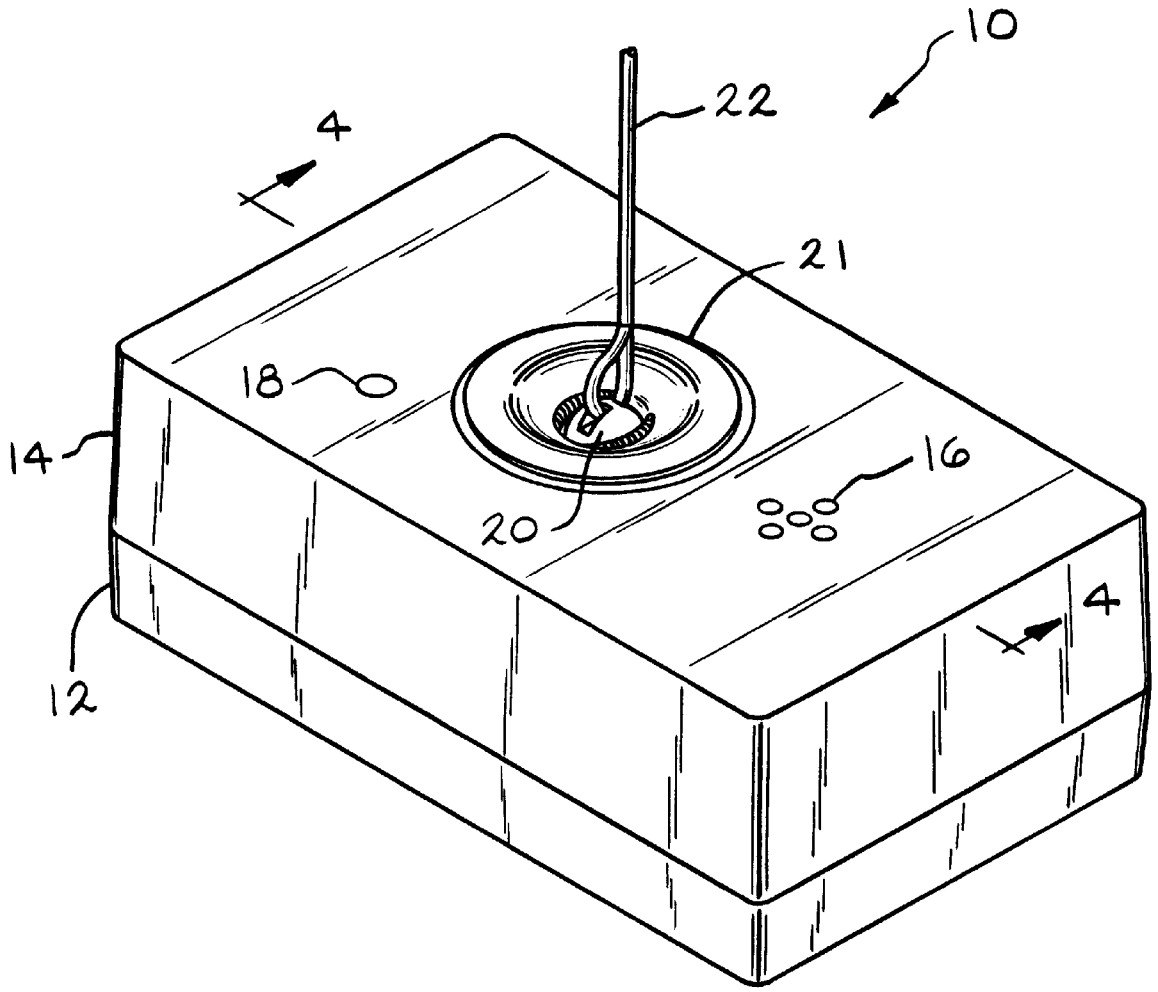
FIG. 1 is an isometric view of the monitoring device.

Turning now to the drawings, FIG. 1 illustrates an isometric view of exterior components of an apparatus 10 for monitoring the movement of a patient. As shown in FIG. 1, the exterior components include a bottom enclosure 12, a top enclosure 14, a signal aperture 16, a light aperture 18, a spherical member 20, a spherical receiver 21, and a flexible member 22 (collectively "Exterior Components"). These Exterior Components will be described in greater detail.

Figure 2:
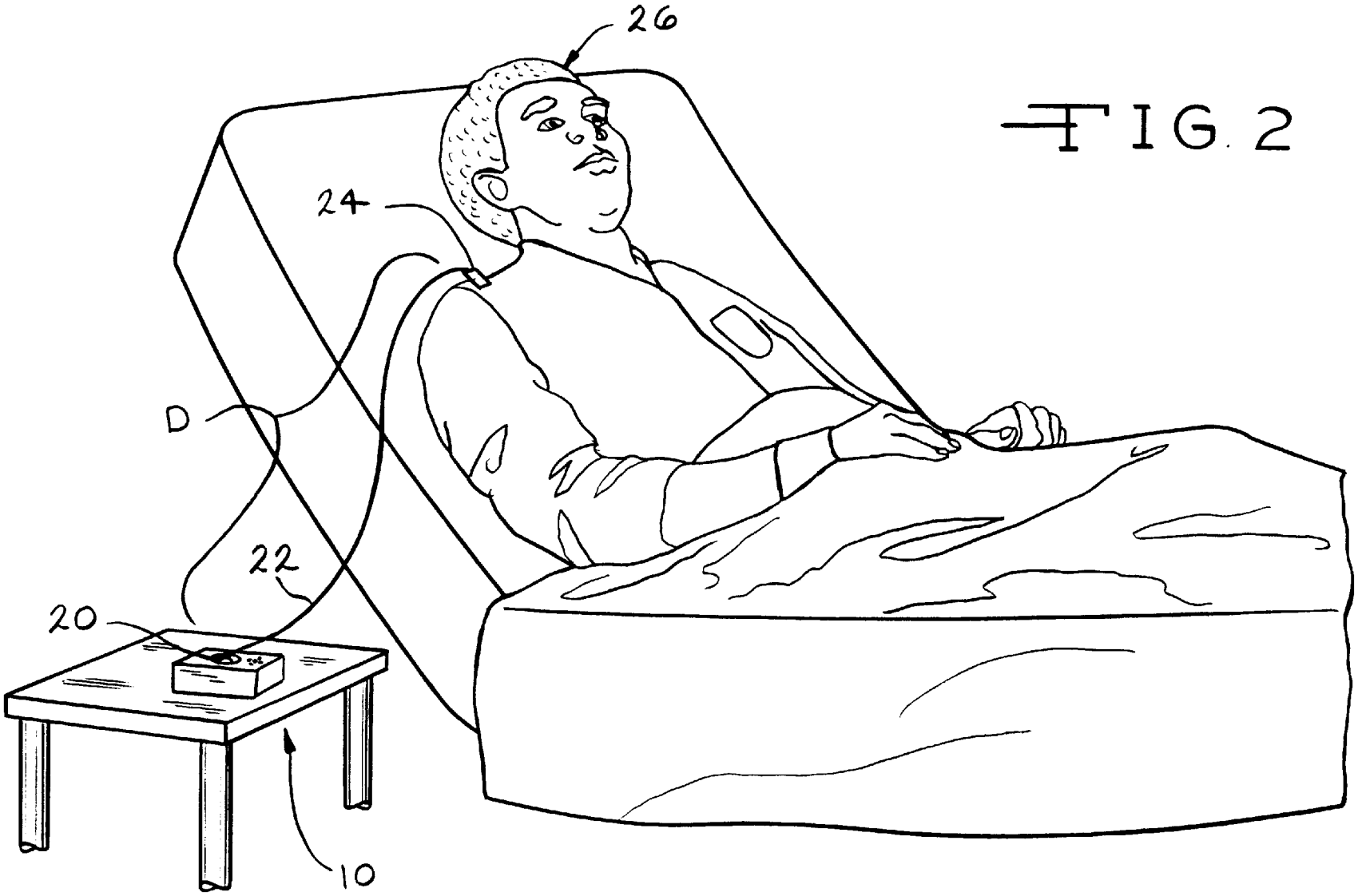
FIG. 2 is a perspective view of the monitoring device of FIG. 1 being used to monitor a patient.

The Exterior Components of apparatus 10 also include a fastening means 24. This fastening means 24 connects to a patient 26 as shown in FIG. 2. The fastening means 24 can be any device that secures itself to a patient in any manner or form. One such fastening means 24 is an alligator clip. Other conventional fastening means 24 are fully disclosed in U.S. Pat. Nos. 4,577,185, 4,858,622, and 4,583,084, which patents are hereby incorporated fully by reference. The fastening means 24 securely connects to one end of the flexible member 22. Similarly, the spherical member 20 securely connects to the other end of the flexible member 22.

The length of the flexible member 22, the fastening means 24 and the spherical member 20 (collectively "Leash") is a pre-determined distance (D). The only prerequisite for the Leash is that when the patient 26 extends the Leash to its maximum length (D), the patient 26 exerts a pulling force (F) on the Leash. The distance (D) of the Leash can be any length. The length can be adjusted by shortening or adding extensions to the flexible member 22. Such an adjustment allows the patient 26 a normal range of movement without applying the pulling force (F). The flexible member 22 can be any type of material(s), such as cord, plastic, metal or combinations thereof.

Figure 3:
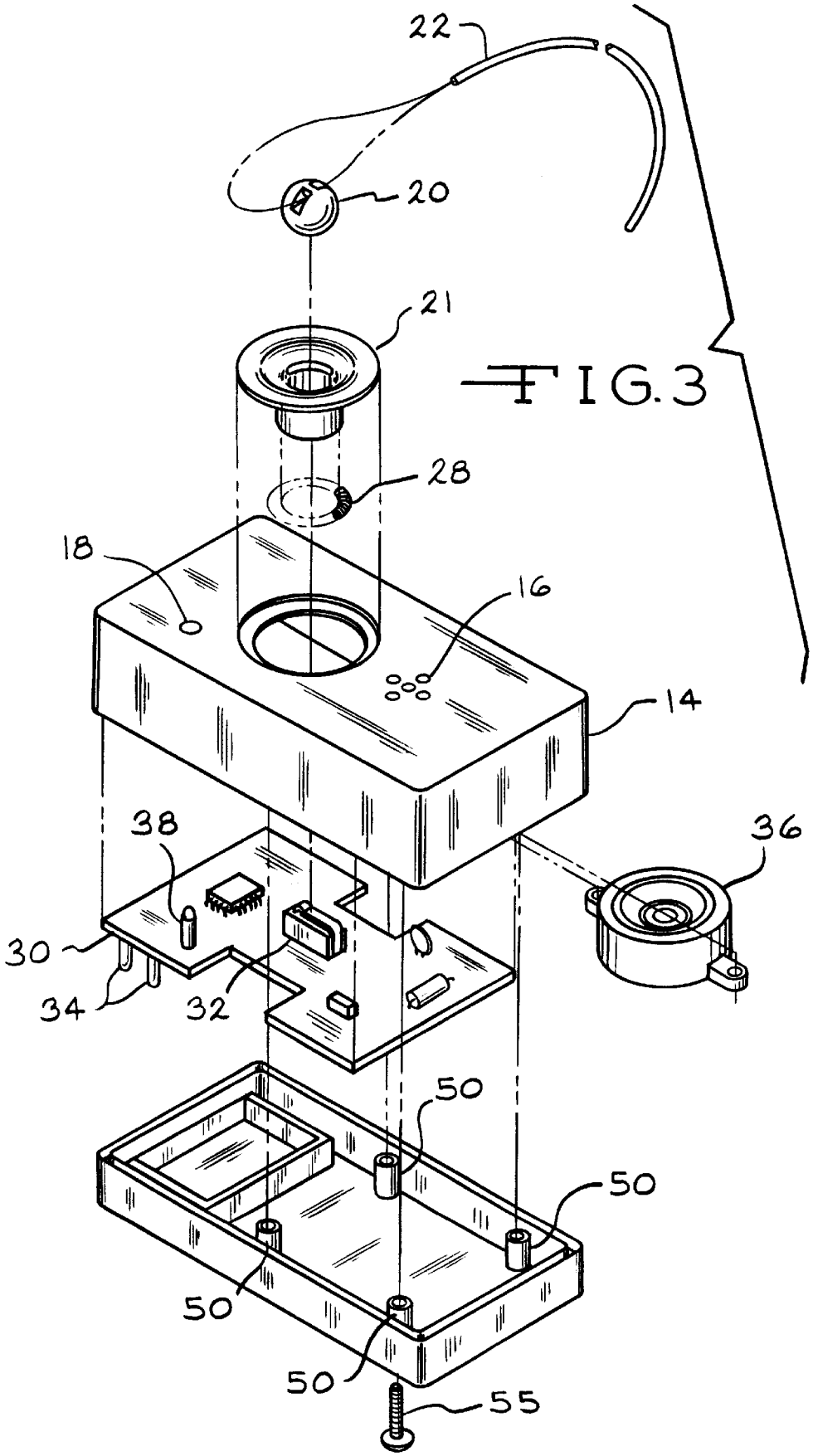
FIG. 3 is an exploded view of FIG. 1.

Turning to the next drawing, FIG. 3 illustrates an exploded view of the apparatus 10. Besides the Exterior Components mentioned above, the apparatus includes a retention device 28, a circuit board 30, a movement switch 32, a power input 34, a signalling device 36, and an LED device 38. The circuit board 30 is a conventional board, such as Motorola's part no. MC14467-1, that interconnects the LED device 38, the power input 34, the signalling device 36 and the movement switch 32.

The power input 34, as illustrated, can be electrical contacts. Such electrical contacts interconnect to a battery, i.e., a nine volt battery. In another embodiment, the power input 34 can be an electrical system that connects to a conventional electrical outlet. The LED device 36, interconnected to the power input 34, is a conventional device that indicates whether the apparatus 10 has sufficient power. If the apparatus 10 has sufficient power, the power input 34 illuminates the LED device 38 and provides sufficient electricity to activate the movement switch 32, such as Microswitch's part no. US20D20E00, and signalling device 36, such as Monaco Components' part no. MB-6400-S.

Figure 7:
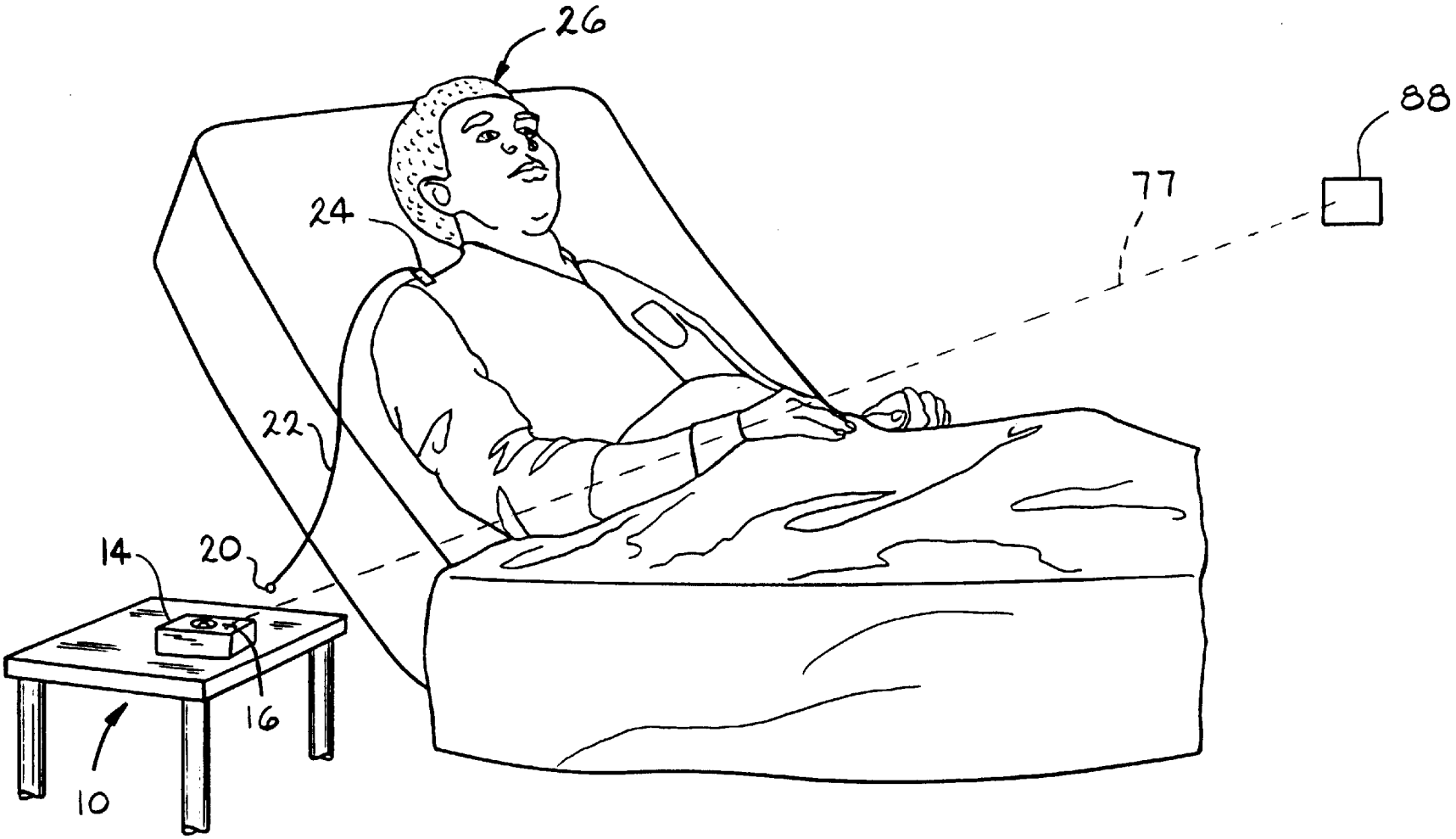
FIG. 7 is an alternative embodiment of FIG. 3.

The signalling device 36, in one embodiment, generates a sound. That sound warns the patient 26 to not move any further. Similarly, the signalling device 36 in another embodiment, generates a luminescent indicator. That indicator also alerts the patient to not move any further. In yet another embodiment of the signalling device 36, the device 36 transmits a signal 77, i.e., a telephone signal or other electronic transmission, to a caretaker 88 as shown in FIG. 7. That signal notifies the caretaker that the patient has moved too far. The caretaker receives such signal in the form of a luminescent indicator, a sound, or an electronic transmission indicator. Each of these signalling devices are conventional instruments and are fully disclosed in U.S. Pat. Nos. 4,577,185, 4,858,622, and 4,583,084, which patents are hereby incorporated fully by reference.

Figure 4:
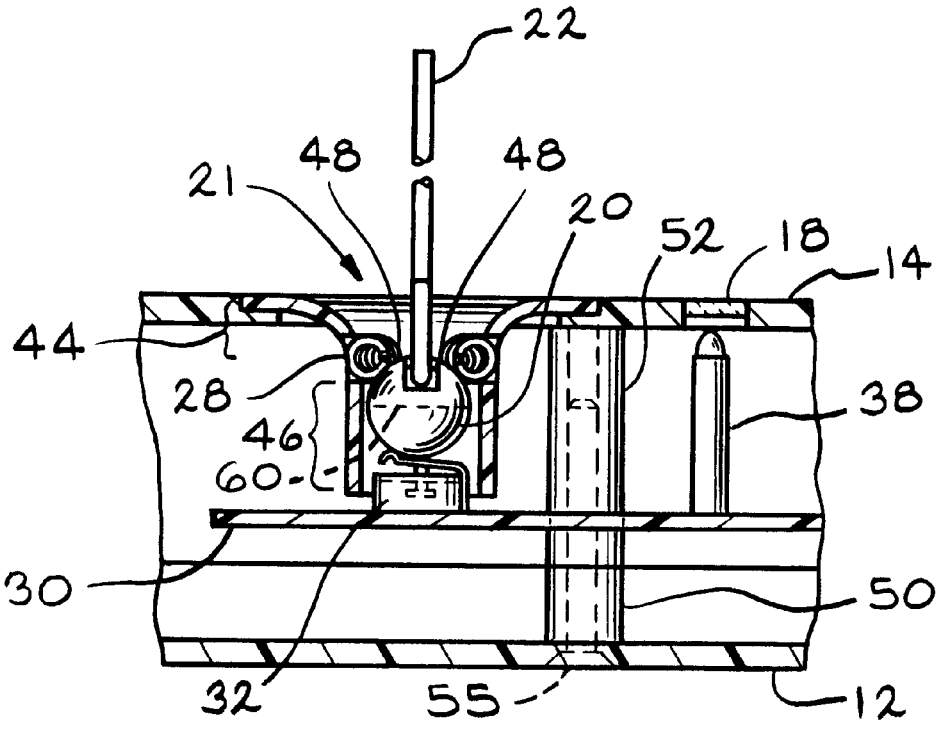
FIG. 4 is a cross-sectional view of FIG. 1 taken along line 4—4.

The signalling device 36 is not activated until the movement switch 32 is altered. The movement switch 32 is a conventional spring loaded switch that has two settings. The first setting is in the closed position, as shown in FIG. 4. The first setting occurs when the spherical member 20 is removably mounted within the spherical receiver 21 and on the movement switch 32. The first setting or adjusting the movement switch 32 to the first setting does not trigger the signalling device 36 to generate its alarm.

Figure 5:
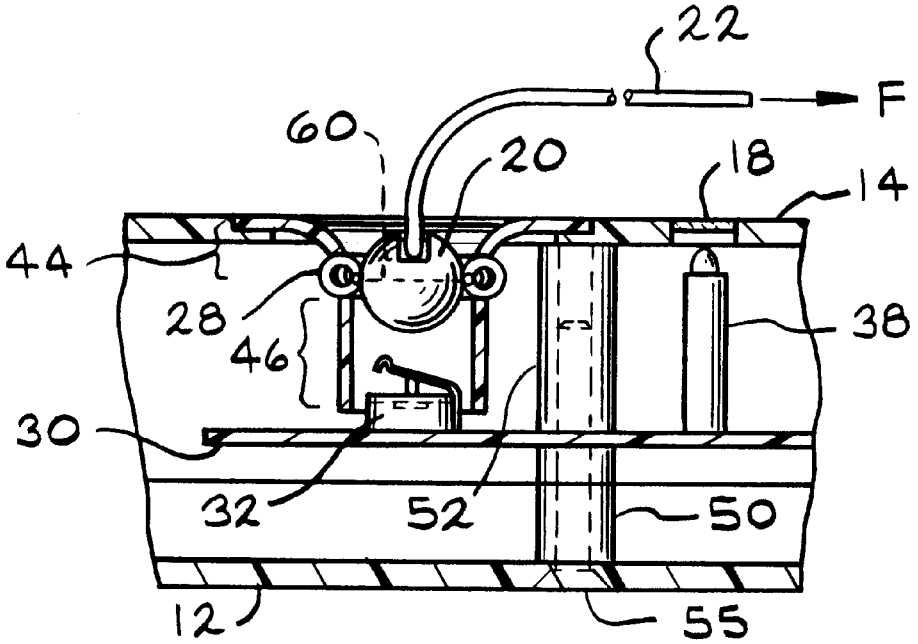
FIG. 5 is a view of FIG. 4 when a pulling force is initially applied.

The second setting of the movement switch 32, as shown in FIG. 5, is in the open position. The open position occurs when the spherical member 20 is not contacting the movement switch 32. Under conventional dynamic principles, the second setting is the preferred setting for the movement switch 32 because it has the least amount of potential energy. Once the movement switch 32 alters to the second setting, the movement switch 32 triggers the signalling device 36 to generate its alarm.

The movement switch 32 alters its settings when the position of the spherical member 20 is altered. The first setting should not be altered to the second setting unless the patient 26 moves beyond the pre-determined distance (D). In order to preclude such undesired alterations, the apparatus 10 has the spherical receiver 21.

The spherical receiver 21 has a tapered portion 44, the retention device 28, and a switch portion 46. The switch portion 46 is tubular and has a diameter slightly greater than the diameter of the spherical member 20. The switch portion 46 receives the spherical member 20 so that the spherical member 20 alters the movement switch 32 into the first setting. The spherical member 20 remains on and in contact with the movement switch 32 due to the retention device 28.

The retention device 28 applies the minimal amount of pushing or biasing force on the spherical member 20 so that the spherical member 20 is not accidently discharged from the spherical receiver 21. A relatively slight pulling force (F) will overcome the pushing force of the retention device 28. One embodiment of the retention device 28 is a spring. The ends of the spring are interconnected to form a circle. That circle spring is inserted into the spherical receiver 21 and contacts the peripheral edges 48 of the spherical member 20 at a position on the opposite side of the sphere's equator (line 60) spaced from the movement switch 32, as shown in FIG. 4. Preferably, the retention device 28 separates the switch portion 46 from the taper portion 44.

The taper portion 44, as shown in FIG. 5, has an arcuate edge design. The arcuate edges have the narrow diameter at the retention device and the broad diameter at the top enclosure 14. This design assists the spherical member 20 to readily dislodge itself from the switch portion when the patient 26 applies a sufficient pulling force (F) to the Leash when it is fully extended.

The spherical member 20 is spherical and made of any durable material, such as metal, plastic or even wood. The spherical member 20 easily rotates within the switch portion 46, as discussed above. Such easy rotation ensures the spherical member 20 rotates its position relative to the position of the flexible member 22 within the taper portion 44 when the Leash is fully extended.

Figure 6:
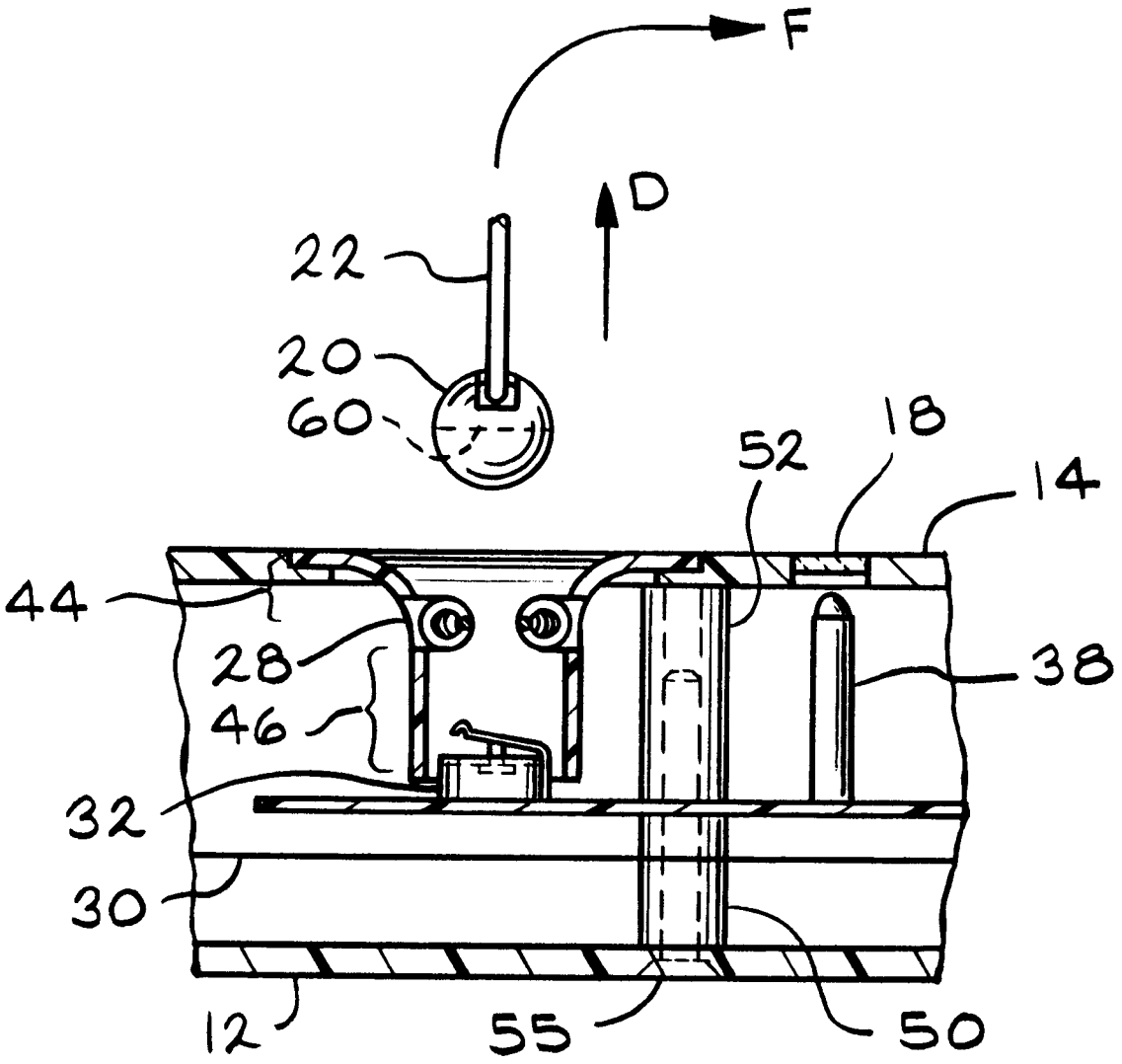
FIG. 6 is a view of FIG. 4 when a pulling force is completely applied.

The combination of the taper portion 44 and the spherical member 20 is a symbionic relationship. The taper portion 44 insures that whenever the patient 26 applies even a relatively slight pulling force (F) from any direction relative to the apparatus 10 that the flexible member 22 within the taper portion 44 will be near or at a 180° angle relative to spherical member 20. Such insurance is possible because the spherical member 20 easily rotates its position relative to the position of the flexible member 22 within the taper portion 44 when the Leash is fully extended. Thereby, when the patient 26 applies the pulling force (F) the spherical member 20 moves along the switch portion 46 and away from the switch 32. Once the retention device 28 is at a position coinciding to the equator 60 of the spherical member 20 (see FIG. 5), the least little additional amount of pulling force on the flexible member 22 causes the retention device 28 to oscillate to its untensioned position thereby releasing the spherical member 20 from the receiver 21, as shown in FIG. 6. Once the spherical member 20 is dislodged, the movement switch 32 triggers the alarm of the signalling device 36.

Returning to FIG. 3, the top enclosure 14 and bottom enclosure 12 protect the interior components, i.e., all components attached to the circuit board, from damage and unnecessary exposure. The bottom enclosure 12 has a set of supports 50 (FIGS. 3 to 6). Each support 50 is a hollow tube that extends from an opening at the exterior surface of the bottom enclosure 12. The bottom enclosure 12 receives the top enclosure 14. The top enclosure 14 also has a set of supports 52 (FIGS. 4 to 6) that are hollow tubes. Each set of supports 50, 52 mate with each other when the top enclosure 14 aligns with the bottom enclosure 12. A fastening tool 55, i.e., a screw, secures that alignment by being inserted into each hollow tube of set 50 and the matching hollow tube of set 52.

The light aperture 18 is any type of aperture that allows the LED device 38 to be seen on the exterior surface, i.e., the top enclosure 14, of the apparatus 10. Similarly, the signal aperture 16 is any type of aperture that allows the alarm, i.e., sound and rf frequency, of the signalling device 36 to be transmitted to the desired party.

The apparatus 10 has a fundamental operation. The present invention operates when the fastening means 24 connects to the patient 26. The fastening means 24 attaches to one end of the flexible member 22 and at the other end of the flexible member 22 is a spherical member 20. The apparatus 10 limits the distance the patient 26 can move. This predetermined distance (D) is the length of the flexible member 22, the fastening means 24 and the spherical member 20. The spherical member 20 is removably mounted to a control housing 10. The control housing 10 has a signalling device 36 that generates a signal when the patient 26 moves beyond the pre-determined distance (D). The spherical member 20 triggers the signalling device 36 when the patient 26, from any direction, moves beyond the pre-determined distance (D) to exert a pulling force (F) upon the spherical member 20 sufficient to overcome the biasing force of the retention device 28 to thereby release the spherical member 20 from the receiver 21. This causes the movement switch 32 to actuate into the second setting corresponding to the open position to trigger the signalling device 36 to generate its alarm.

While the preferred embodiments of the present invention have been set forth in the above-detailed description, the preferred embodiment is only an example of the invention. Other modifications may be used without departing from the scope of the present invention, and the invention is limited by the following claims and their equivalents.

We claim the following:

1. An apparatus for monitoring the movement of a patient, comprising:

a control housing mounted within at least a pre-determined distance from a patient;

a fastening apparatus connected to the patient;

a flexible member connected on one end to the fastening apparatus;

a spherical member connected to the other end of the flexible member and removably mounted in the control housing;

a signaling apparatus that becomes activated when the patient moves beyond the predetermined distance;

a movement switch mounted in the control housing, the movement switch interconnected to the signaling apparatus, and the movement switch being adapted to move from a first position to a second position;

a retention device that applies a biasing force upon the spherical member;

the first position occurring when the spherical member contacts the movement switch, thereby closing the movement switch; and the second position occurs when the patient moves beyond the pre-determined distance in any direction relative to the control housing and thereby exerts a pulling force upon the spherical member that opens the movement switch and activates the signaling apparatus.

2. The apparatus of claim 1 further comprising a spherical receiver mounted on the control housing, the spherical receiver receiving the spherical member.

3. The apparatus of claim 2 wherein the biasing force keeps the spherical member in the spherical receiver until the patient applies the pulling force from any direction.

4. The apparatus of claim 2 wherein the retention device is in the spherical receiver.

5. The apparatus of claim 1 wherein the signaling apparatus transmits a signal selected from the group consisting of a sound alarm to the patient, a sound alarm to a caretaker, a luminescent alarm to the patient, a luminescent alarm to the caretaker, and combinations thereof.

6. The apparatus of claim 1 wherein the biasing force is applied to the spherical member so the spherical member contacts the movement switch until the pulling force is applied.

7. A method of monitoring the movement of a patient comprising the steps of:

connecting a fastening apparatus to the patient, and wherein the fastening apparatus is connected to one end of a flexible member and at the other end of the flexible member is a spherical member, the length of the flexible member, the fastening apparatus and the spherical member is a pre-determined distance, the spherical member is removably mounted to a control housing, the control housing has a signaling apparatus when the patient moves beyond the pre-determined distance; and activating the signaling apparatus when the patient, from any direction, moves beyond the pre-determined distance which exerts a pulling force upon the spherical member.

8. The method of claim 7 further comprising the step of: mounting the control housing within at least said pre-determined distance from the patient in any direction.

9. The method of claim 7 wherein the signaling apparatus transmits a signal selected from the group consisting of a sound alarm to the patient, a sound alarm to a caretaker, a luminescent alarm to the patient, a luminescent alarm to the caretaker, and combinations thereof.

* * * * *